US006231023B1

(12) United States Patent
Morton

(10) Patent No.: US 6,231,023 B1
(45) Date of Patent: May 15, 2001

(54) ERASABLE PORTABLE EASEL

(76) Inventor: Richard Joseph Morton, 4 Central Ave., Sausalito, CA (US) 94965

( * ) Notice: Subject to any disclaimer, the term of this patent is extended or adjusted under 35 U.S.C. 154(b) by 0 days.

(21) Appl. No.: 09/250,022

(22) Filed: Feb. 11, 1999

(51) Int. Cl.[7] ..... A47B 19/00

(52) U.S. Cl. ..... 248/441.1; 248/444.1; 248/450; 248/460

(58) Field of Search ..... 248/441.1, 442.2, 248/447.1, 447, 453, 454, 456, 463, 464, 465.1, 450, 444, 444.1, 459, 460, 455, 457; 206/45.2, 45.25; 281/29, 33; 40/764

(56) References Cited

U.S. PATENT DOCUMENTS

| | | | | |
|---|---|---|---|---|
| 4,143,847 | * | 3/1979 | Cross | 248/459 |
| 4,544,123 | * | 10/1985 | Peacock | 248/460 |
| 4,848,243 | * | 7/1989 | Giordano | 248/455 X |
| 4,926,512 | * | 5/1990 | Coyle | 5/417 |
| 4,951,993 | * | 8/1990 | Taboada | 296/136 |
| 5,149,047 | * | 9/1992 | Tucker | 248/459 |
| 5,193,777 | * | 3/1993 | Faulstich | 248/441.1 |
| 5,234,190 | * | 8/1993 | Cross | 248/459 |
| 5,244,267 | * | 9/1993 | Fossier, Jr. et al. | 248/460 X |
| 5,377,794 | * | 1/1995 | Book | 190/1 |
| 5,451,025 | * | 9/1995 | Hames | 248/457 X |
| 5,480,118 | * | 1/1996 | Cross | 248/459 |
| 5,570,526 | * | 11/1996 | Wallon | 248/455 X |
| 5,653,333 | * | 8/1997 | Webster | 206/45.2 |
| 5,720,464 | * | 2/1998 | Meinscher et al. | 248/447 |
| 5,722,628 | * | 3/1998 | Menaged | 248/455 X |
| 5,810,182 | * | 9/1998 | Levin | 211/195 |
| 5,823,500 | * | 10/1998 | La Coste | 248/444 |
| 5,893,546 | * | 4/1999 | Renfroe | 248/451 |
| 6,053,467 | * | 4/2000 | Walker et al. | 248/450 |

* cited by examiner

*Primary Examiner*—Leslie A. Braun
*Assistant Examiner*—Tan Le
(74) *Attorney, Agent, or Firm*—Risto A. Rinne, Jr.

(57) ABSTRACT

An apparatus for the display and presentation of materials, such as an artist's painting, has a first planar member that includes a glossy surface on one side that is adapted to receive a marking thereon and which is readily erasable. The first planar member also includes a lip adapted to hold the painting adjacent to and in parallel planar alignment with respect to the first planar member. A second planar member that preferably includes a smaller length and width than the first planar member is disposed behind the first planar member and is hingedly attached thereto about an axis with a membrane type of an elastomeric hinge that is attached to both the first and second planar members. A first end of a cord passes through a first aperture in the first planar member and the lip where it is secured in position. The cord extends through a second and a third aperture in the second planar member and back to the first planar member where it passes through a fourth aperture where it is secured where desired along the length of the cord by an adjustable stopper. By adjusting the position of the stopper, the length of cord intermediate the first end and the stopper is varied. As the length of the cord is varied, the position of an end of the second planar member that is opposite the membrane hinge is determined as it pivots about the axis either closer to or further away from the first planar member. The second end of the cord passes through a fifth aperture in the first planar member and is secured in a notch formed in the first planar member to provide a carrying strap for portage of the device.

17 Claims, 1 Drawing Sheet

ERASABLE PORTABLE EASEL

The present application is related to a prior patent application filed by the same inventor on Nov. 3, 1988, Ser. No. 07/266,658, now abandoned.

BACKGROUND OF THE INVENTION

1. Field of the Invention

The present invention, in general relates to artist and presentation supplies and, more particularly, to easels.

Easels are well known devices used by artists to hold a canvas, or the like, during formation of the artwork. There are, however, a number of problems that previous types of easels may experience.

One problem relates to the portability of the easel and, in particular, the thickness of the easel when it is folded for transport and also its weight. Previous types of easels are often thicker and heavier than is desirable. Therefore it is desirable to construct an easel that is as thin and as light in weight as possible.

A second problem with known types of easels relates to the stability of the easel. If the easel is placed on a table having an especially smooth surface, there is the possibility with some previous types of easels, that the legs which support them may slip, possibly causing the artwork to fall. Therefore, a stable easel is required.

A similar need exists in the presentation arts in that a stable erasable board that is easy to transport is useful in creating effective presentations, and then by erasing the images on the board, reusing it later.

Another rather unique need exists for artists as well. Often, artists make preliminary sketches and then, using the sketch, actually compose the final artwork. Sometimes, changing conditions like a sunset or moving cloud patterns demand that only the most essential features of the scene be quickly recorded.

It is desirable to be able to use the easel itself to make such sketches directly upon its surface. This ability saves the artist from having to transport any "boards" (canvas or otherwise). The board would not be a separate piece requiring transport. The easel, ideally, would function so as to provide both a stable platform as well as the surface upon which an image could be formed by the artist.

The artist would then take the easel having the cursory image (sketch) to his or her studio and, using it along with his or her memory of the scene, create the finished artwork. Afterward, the image on the easel would be erased for later reuse.

There is also a further need to be able to readily adjust the angle at which an easel leans backward. This utility applies to both artists and for presentation purposes. For example, in a still indoor setting, a more vertical orientation may facilitate display and access to the image. However, in a windy outdoor setting, a more angled orientation would provide greater stability and immunity from the wind.

Not only is it desirable to be able to adjust the angle, but it must be accomplished quickly and it must maintain itself at the proper attitude. Prior types of easels, while being adjustable as to the angle, can slip if a thumbscrew, for example, is not adequately tightened. It is difficult for a user who has had one of the prior types of easels fall to feel secure that he or she has in fact sufficiently tightened the thumbscrews. As a consequence of this uncertainty, there is a tendency to over tighten the thumbscrews, thereby making it difficult to later loosen them. The overall effect is to provide a product that is unpleasant to use, at least, in this regard.

Accordingly there exists today a need for an erasable easel that includes a surface that can receive an image that can later be erased and which is light in weight, folds thin and is readily adjustable as to the angle presented and is stable when so adjusted.

Clearly, such an apparatus would be a useful and desirable device.

2. Description of Prior Art

Easels are, in general, known. For example, the following patents describe various types of these devices:

U.S. Pat. No. 937,671 to Borgzinner, and

U.S. Pat. No. 2,127,494 to Tepper.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an erasable, portable easel that is easy to transport.

It is also an important object of the invention to provide an erasable, portable easel that is light in weight.

Another object of the invention is to provide an erasable, portable easel that folds thin for transport.

Still another object of the invention is to provide an erasable, portable easel that includes a first planar member adapted for holding a canvas that is adjustable in its angle of presentation with respect to a user.

Still yet another object of the invention is to provide an erasable, portable easel that includes a second planar member that is hingedly attached about an axis to a first planar member.

Yet another important object of the invention is to provide an erasable, portable easel that includes a flexible membrane hinge.

Still yet another important object of the invention is to provide an erasable, portable easel that includes a method of adjusting the relative position between the first and second planar members.

Still yet one more object of the invention is to provide an erasable, portable easel that includes a carrying strap to aid in portage.

Briefly, an erasable, portable easel that is constructed in accordance with the principles of the present invention has a first planar member that includes a glossy surface that is adapted to receive a marking thereon and which is readily erasable. The first planar member also includes a lip attached thereto that is adapted to hold a planar object, such as a painting, adjacent to and in parallel planar alignment with respect to the first planar member. A second planar member that is preferably smaller in both length and width than the first planar member is disposed behind the first planar member and is hingedly attached thereto about an axis with a membrane type of a hinge that is attached to both the first and the second planar members. A first end of a cord passes through a first aperture in the first planar member and the lip where it is secured in position. The cord extends through a second and a third aperture in the second planar member and back to the first planar member where it passes through a fourth aperture where it is secured where desired along the length of the cord by an adjustable stopper. By adjusting the position of the stopper, the length of cord intermediate the first end and the stopper is varied. As the length of the cord is varied, the position of an-end of the second planar member that is opposite the membrane hinge is determined as it pivots about the axis either closer to or further away from the first planar member. The second end of the cord passes through a fifth aperture in the first planar member and is secured in a notch formed in the first planar member to provide a carrying strap for portage of the device.

DETAILED DESCRIPTION OF THE INVENTION

Figure 1:
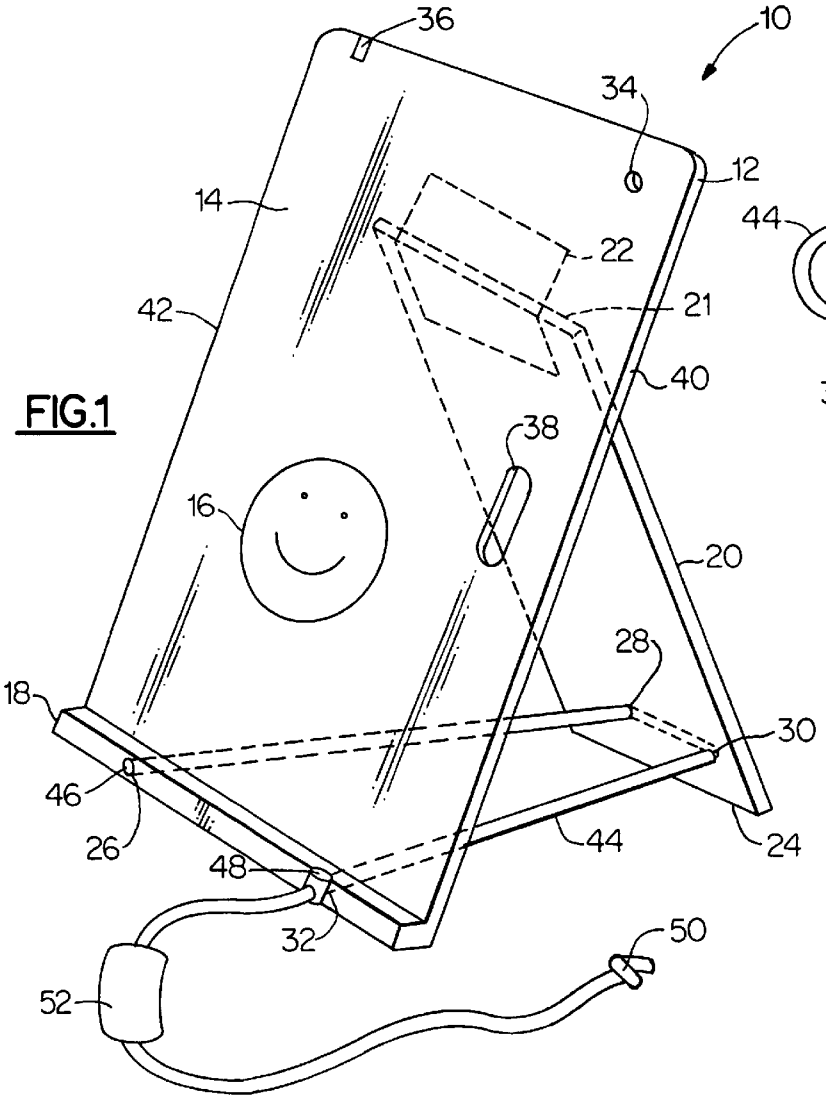
FIG. 1 is a view in perspective of the erasable, portable easel ready for use.

Referring to FIG. 1 and on occasion to all of the FIGURE drawings is shown, an erasable, portable easel, identified in general by the reference numeral 10.

A substantially rectangular first planar member 12 includes a smooth surface 14 applied to one side thereof. The smooth surface 14 is adapted to receive an image 16 applied thereto.

Typically the image 16 is applied to the smooth surface 14 using markers or the like (not shown) that produce an impermanent marking. The image 16 is erased by rubbing it with an eraser or cloth and is then ready to receive a subsequent image (not shown). The image 16 is used as a preliminary sketch by an artist (not shown) or for presentation purposes.

A lip 18 is attached to the first planar member at a first end thereof. The lip 18 is attached by use of an adhesive or by any type of a fastener (not shown) that is applied through the first planar member 12 to the lip 18.

The lip 18 provides a supporting shelf useful for placing objects thereon. The objects (not shown) may include an artist canvas board, a sketch pad, markers, or other presentation materials.

A second planar member 20 that is smaller than the first planar member 12 is disposed on the side opposite that of the smooth surface 14. The second planar member 20 is pivotally attached at a first end 21 thereof to the first planar member 12 so as to pivot about an axis with respect thereto.

The axis is parallel with respect to the first end thereof of the second planar member 20 and is formed by a flexible membrane 22, one half of which is attached to the first planar member 12 and the remaining half of which is attached to the second planar member 20.

The flexible membrane 22 is formed of any desirable material that is sufficiently elastomeric so as to permit functioning as a hinge. It is also as thin as possible so as to reduce the combined thickness of the first planar member 12, the flexible membrane 22, and the second planar member 20. Canvas is a presently preferred material in this regard.

The flexible membrane 22 is attached to the first end 21 of the second planar member 20 and to the back surface of the first planar member 12 by an adhesive. The use of an adhesive is advantageous in that it is quick to apply and does not rely upon any type of a fastener having to penetrate through the first planar member 12 thereby adversely affecting the smooth surface 14.

Figure 2:
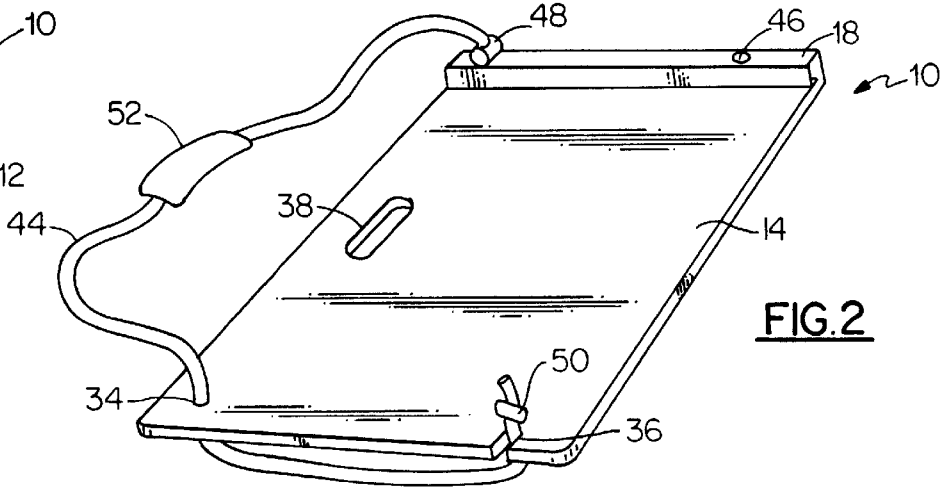
FIG. 2 is a view in perspective of the erasable, portable easel ready for transport.

The second planar member 20 includes a second end 24 that is disposed opposite with respect to the first end 21 thereof. The second planar member 20 is pivotable about the axis between a first position where the second end 24 is disposed away from the first planar member 12 as shown in the FIG. 1 illustration and a second position where the second end 24 is adjacent the first planar member 12 as shown in the FIG. 2 illustration.

In the first position the easel 10 is adapted for use and in the second position it is adapted for portage, being configured as thinly as is possible.

A first aperture 26 is provided through the lip 18 and the first planar member 12 so as to align with respect to each other. A second aperture 28 is formed through the second planar member 20 proximate the second end 24 thereof and it aligns with the first aperture 26 when the second planar member 20 is disposed in the second position.

A third aperture 30 is formed through the second planar member 20 proximate the second end 24 thereof disposed a predetermined distance from the second aperture 28. A fourth aperture 32 is formed through the lip 18 and the first planar member 12 so as to align with respect to the third aperture 30 when the second planar member 20 is disposed in the second position.

A fifth aperture 34 is provided through the first planar member 12 at an end thereof that is disposed furthest away from where the lip 18 is attached. The fifth aperture 34 is disposed on the same side of the first planar member 12 as is the fourth aperture 32.

A notch 36 is formed beginning at an edge of the first planar member 12 on the end thereof that is disposed furthest away from where the lip 18 is attached and it extends a predetermined distance into the first planar member 12. The notch 36 is formed as a result of the removal of material from the first planar member 12.

A slot 38 is formed in the first planar member intermediate the end thereof that is disposed furthest away from the lip 18 and the end where the lip 18 is attached proximate a first side 40 thereof. The slot 38 functions as a carrying handle, and is discussed further hereinbelow.

A second side 42 is disposed opposite the first side 40. Together, the end thereof that is disposed furthest away from the lip 18, the first end (where the lip 18 is attached), the first side 40, and the second side 42 of the first planar member 12 generally define a rectangular structure that is as thin as possible.

A cord 44 includes a knotted first end 46 that passes through the first aperture 26. The knotted first end 46 retains the first end 46 of the cord 44 in position. The cord 44 then passes through the second aperture 28 around the back of the second planar member 20, through the third aperture 30, and through the fourth aperture 32 where it is secured by a stopper 48.

If the cord 44 is grasped near the stopper 48 and is pulled, the second end 24 of the second planar member 20 will be drawn into closer proximity with respect to the first planar member 12. The stopper 48 is then squeezed and moved adjacent to the fourth aperture 32 where it is released to secure the easel 10 in the new position.

The use of the stopper 48 is known, particularly in the backpacking arts, as a way of securing a pouch (not shown), for example, in a closed position. The stopper 48 contains two concentrically disposed cylinders, each having an aperture (not shown) and each cylinder being pushed apart with respect to each other by an internal spring. The apertures align when the two cylinders are manually pushed together by the user. At this time, the stopper 48 can be freely moved where desired along the length of the cord 44.

When the two cylinders are released the apertures are urged away from each other thereby pinching the cord 44 and securing the stopper 48 in position. If the cord 44 is then pulled, the stopper 48 abuts the lip 18 and prevents additional length of the cord 44 from passing through the fourth aperture 32.

The closer that the second end 24 is disposed with respect to the first planar member 12, the more upright or erect the first planar member 12 is disposed.

Conversely, the further the second end 24 is disposed away from the first planar member 12, the more angled will be the first planar member 12. This allows a user to select an attitude for the first planar member 12 best suited to the needs of the situation.

It is also noted that as the cord is pulled through the fourth aperture 32 a given amount, the second end 24 is urged toward the first planar member 12 one-half that amount. This is because the length of the cord 44 intermediate the first and the second planar members 12, 20 must be taken up on two sections thereof. The first section is intermediate the first and second apertures. The second section is intermediate the third and fourth apertures.

This provides a mechanical advantage when pulling the cord 44 through the fourth aperture 32. Accordingly, it is easy to adjust the position of the second planar member 20 with respect to the first planar member 12.

Referring briefly primarily to FIG. 2, a second end 50 of the cord 44 is also tied in a knot. The second end 50 passes through the fifth aperture 34, which is formed sufficiently large to permit it to do so, and is placed in the notch 36 typically only when the easel 10 is disposed in the second position, ready for transport. The notch 36 is narrow enough so as to prevent the second end 50 of the cord 44 from falling out or to let the knot pass through the notch 36.

A shoulder strap member 52 includes a soft material with an opening extending along its longitudinal length. The cord 44 passes through the opening. The shoulder strap member 52 can readily be moved along the length of the cord 44 into the desired position. When the easel 10 is in the second position and the cord 44 is so placed, the shoulder strap member 52 is placed over the shoulder of the user and carried.

If desired, the slot 38 is grasped by the user and is also used to transport the easel 10.

Figure 3:
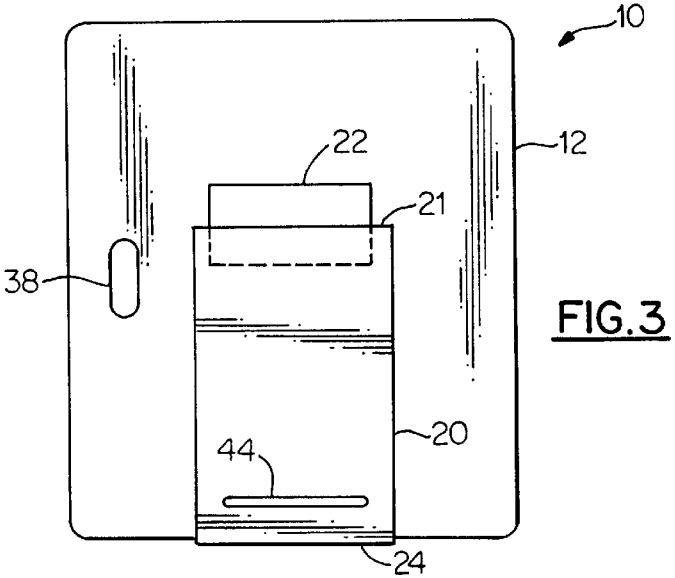
FIG. 3 is a rear elevational view of the back portion of the erasable, portable easel folded for transport.

When the easel 10 is in the second position, as shown in both FIGS. 2 and 3, the cord 44 is pulled tight, thereby causing the second planar member 20 to pivot about the axis until the second end 24 is disposed adjacent the first planar member 12 and the second planar member 20 is generally disposed in parallel planar alignment with respect to the first planar member 12.

The stopper 48 is then urged into its normal position which is adjacent the lip 18 at the fourth aperture 32, thereby retaining the easel 10 in the second position.

When the easel 10 is disposed in the first position, the tendency is for the second end 24 of the second planar member 20 to attempt to pull even further away from the first planar member 12, merely as a result of the weight of the easel 10 and any objects that may be disposed on the lip 18 thereof.

Accordingly, the stopper 48 prevents additional length of the cord 44 from being released, thereby helping to retain the easel in both the first and the second positions. If the easel 10 is placed on an especially slippery surface (one that has a low coefficient of friction), the tendency of the second planar member 20 to try and pivot away from the first planar member 12 would be great.

The use of the cord 44 and the stopper 48, as described, prevent such slippage from occurring thereby providing the easel 10 with stability for use on a variety of surfaces. The cord 44 also provides ease of portability.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An erasable, portable easel, comprising:

(a) a first planar member that is substantially rectangular in shape having a predetermined length, width, and thickness and including a glossy surface disposed on one side thereof, said glossy surface being adapted to receive a temporary marking thereupon and also being adapted for the erasure of said temporary marking and subsequent reuse;

(b) a second planar member that is substantially rectangular in shape having a predetermined length, width, and thickness and having a first end and a second end and including means for pivotally attatching said first end to said first planar member about an axis;

(c) means for limiting the maximum distance said second end is disposed away from said first planar member; and (d) a lip adapted for receiving an object thereon, said lip attached to said first planar member at a side thereof having said glossy surface;

wherein said means for limiting includes a cord having a first end and a second end, said first end passing through a first aperture formed in said first planar member and said lip and extending through a second aperture in said second planar member and through a third aperture in said second planar member back to said first planar member and passing through a fourth aperture in said first planar member and said lip.

2. The easel of claim 1 including a first position wherein said second end of said second planar member is disposed away from said first planar member.

3. The easel of claim 2 including a second position wherein said second end of said second planar member is disposed adjacent to said first planar member.

4. The easel of claim 3 wherein when said easel is disposed in said second position, said first aperture aligns with said second aperture and said third aperture aligns with said fourth aperture.

5. The easel of claim 1 including first means for preventing said first end of said cord from passing through said first aperture in a direction generally from said glossy surface to a surface opposite said glossy surface.

6. The easel of claim 5 wherein said first means for preventing includes a knot formed in said first end of said cord, said knot having a diameter greater than said first aperture.

7. The easel of claim 1 including second means for preventing said cord from passing through said fourth aperture in a direction generally from said glossy surface to a surface opposite said glossy surface.

8. The easel of claim 7 wherein said second means for preventing includes a stopper disposed on said cord, said stopper having a first stopper position that is adapted for moving said stopper along the length of said cord and a second stopper position that is adapted for preventing the movement of said stopper along the length of said cord.

9. The easel of claim 1 wherein said means for pivotally attaching said first end to said first planar member includes an elastomeric hinge.

10. The easel of claim 1 wherein said means for pivotally attaching said first end to said first planar member includes a membrane hinge.

11. The easel of claim 10 wherein said membrane hinge is attached to said first planar member and to said second planar member by an adhesive.

12. The easel of claim 1 including means for carrying said easel.

13. The easel of claim 12 wherein said means for carrying includes a slot formed in said first planar member, said slot adapted for use as a handle.

14. The easel of claim 12 wherein said means for carrying includes said cord including a knot formed in said first end of said cord thereby increasing the diameter of said cord sufficient to prevent said first end from passing through said first aperture and wherein said second end passes through a fifth aperture provided through said first planar member and rests in a notch formed in an edge of said first planar members, and wherein said second end includes a knot thereby increasing the diameter of said cord sufficient to prevent said second end from passing through said notch, and including an excess length of cord said excess length of cord adapted for placement over the shoulder of a user.

15. The easel of claim 14 including a shoulder strap member that is formed of a soft material and which is disposed around said cord intermediate said first end and said second end.

16. The easel of claim 1, including elastomeric means wherein said elastomeric means includes a membrane hinge.

17. The easel of claim 16 wherein said membrane hinge is attached to said first planar member and to said second planar member by an adhesive.

* * * * *